US008884197B2

(12) United States Patent
Gagas et al.

(10) Patent No.: US 8,884,197 B2
(45) Date of Patent: Nov. 11, 2014

(54) INDUCTION COOK TOP WITH HEAT MANAGEMENT SYSTEM

(75) Inventors: John M. Gagas, Milwaukee, WI (US); Scott A. Jonovic, Cottage Grove, WI (US); Richard C. Hochschild, Jr., Grafton, WI (US)

(73) Assignee: Western Industries, Inc., Menomonee Falls, WI (US)

( * ) Notice: Subject to any disclaimer, the term of this patent is extended or adjusted under 35 U.S.C. 154(b) by 1479 days.

(21) Appl. No.: 12/025,430

(22) Filed: Feb. 4, 2008

(65) Prior Publication Data

US 2008/0185376 A1 Aug. 7, 2008

Related U.S. Application Data

(60) Provisional application No. 60/888,080, filed on Feb. 3, 2007.

(51) Int. Cl.
*H05B 6/12* (2006.01)

(52) U.S. Cl.
CPC ..... *H05B 6/1263* (2013.01)
USPC ..... 219/622; 219/623; 219/645; 219/650; 219/667; 219/600

(58) Field of Classification Search
CPC ..... H05B 6/1263; H05B 6/062; H05B 3/746; C21D 9/60
USPC ..... 219/623, 620, 618, 624, 632, 645, 649, 219/650, 656, 662, 667, 677, 600
See application file for complete search history.

(56) References Cited

U.S. PATENT DOCUMENTS

| | | | | |
|---|---|---|---|---|
| 3,797,375 | A | 3/1974 | Cerola | |
| 4,013,859 | A | 3/1977 | Peters, Jr. | |
| 4,100,964 | A | 7/1978 | Gorechev et al. | |
| 4,114,009 | A | 9/1978 | Kiuchi et al. | |
| 4,149,217 | A | 4/1979 | Tucker | |
| 4,169,222 | A * | 9/1979 | Tucker | 219/626 |
| 4,191,875 | A | 3/1980 | Cunningham | |
| 4,206,336 | A | 6/1980 | Cunningham | |
| 4,308,443 | A | 12/1981 | Tucker et al. | |
| 4,396,818 | A | 8/1983 | Kominami et al. | |

(Continued)

OTHER PUBLICATIONS

One page from Sears website www.sears.com/download/misc/kMInduct.pds entitled *Designed for the Everday Chef*, USA.

(Continued)

*Primary Examiner* — Dana Ross
*Assistant Examiner* — Ket D Dang
(74) *Attorney, Agent, or Firm* — Boyle Fredrickson, S.C.

(57) ABSTRACT

An indoor or outdoor induction cook top with a heat management system is disclosed. The cook top controls heat generated by various components, including the electronic controller, mechanical controls, and the induction generators. The heat management system provides precise temperature control and an efficient way of removing heat from the cooktop. The cook top construction provides the ability to incorporate a smooth ceramic glass cook top and a number of induction hobs in multiple arrangements. The cook top also features a reduction in the number of components, the efficient removal of generated heat, the reduction of noise, an increase in performance and a barrier airflow director. Consequently, the cook top may be installed in a countertop without the need for venting above the counter.

14 Claims, 10 Drawing Sheets

(56) References Cited

U.S. PATENT DOCUMENTS

| | | | | | |
|---|---|---|---|---|---|
| 4,415,788 | A | | 11/1983 | Field | |
| 4,431,892 | A | * | 2/1984 | White | 219/623 |
| 4,446,350 | A | | 5/1984 | Mizukawa et al. | |
| 4,446,849 | A | | 5/1984 | McFarland | |
| 4,447,691 | A | | 5/1984 | Mizukawa et al. | |
| 4,453,067 | A | | 6/1984 | Karklys et al. | |
| 4,453,068 | A | | 6/1984 | Tucker et al. | |
| 4,490,596 | A | * | 12/1984 | Hirai et al. | 219/623 |
| 4,501,260 | A | | 2/1985 | Grace | |
| 4,511,781 | A | | 4/1985 | Tucker et al. | |
| 4,549,052 | A | * | 10/1985 | Simon | 219/623 |
| 4,562,827 | A | | 1/1986 | Cerola | |
| 4,603,684 | A | | 8/1986 | Kazuo et al. | |
| 4,686,340 | A | | 8/1987 | Fukasawa | |
| 4,701,588 | A | | 10/1987 | Fukasawa | |
| 4,736,729 | A | | 4/1988 | Beach | |
| 4,750,470 | A | | 6/1988 | Beach et al. | |
| 4,757,177 | A | | 7/1988 | Suzuki et al. | |
| 4,766,880 | A | | 8/1988 | von Blanquet | |
| 4,784,114 | A | | 11/1988 | Muckler et al. | |
| 4,810,847 | A | | 3/1989 | Ito | |
| 4,833,288 | A | | 5/1989 | Poumey | |
| 4,846,146 | A | | 7/1989 | Tucker et al. | |
| 4,886,046 | A | | 12/1989 | Welch | |
| 4,887,587 | A | | 12/1989 | Deutsch | |
| 4,899,028 | A | | 2/1990 | Arai et al. | |
| 4,908,489 | A | | 3/1990 | Panecki et al. | |
| 4,934,337 | A | | 6/1990 | Falk | |
| 4,945,891 | A | | 8/1990 | Cecil | |
| 4,951,646 | A | | 8/1990 | Diekmann et al. | |
| 5,000,160 | A | | 3/1991 | Dunlop et al. | |
| 5,001,970 | A | | 3/1991 | Graver | |
| 5,010,223 | A | | 4/1991 | Kim | |
| 5,062,410 | A | | 11/1991 | Sarnosky et al. | |
| 5,111,014 | A | | 5/1992 | Tanaka et al. | |
| D327,538 | S | | 6/1992 | Falk et al. | |
| 5,119,802 | A | | 6/1992 | Cherry et al. | |
| 5,158,068 | A | | 10/1992 | Pickering | |
| 5,190,026 | A | | 3/1993 | Doty | |
| 5,208,217 | A | | 5/1993 | Katsoyannis | |
| 5,209,217 | A | | 5/1993 | Beach et al. | |
| 5,213,091 | A | | 5/1993 | Beach | |
| 5,286,942 | A | | 2/1994 | McFadden et al. | |
| 5,376,775 | A | | 12/1994 | Lee | |
| 5,428,207 | A | | 6/1995 | Essig et al. | |
| 5,430,273 | A | | 7/1995 | Bogdanski et al. | |
| 5,446,268 | A | | 8/1995 | Chen | |
| 5,572,205 | A | | 11/1996 | Caldwell et al. | |
| 5,900,175 | A | | 5/1999 | Kicherer et al. | |
| 6,198,080 | B1 | | 3/2001 | Rice et al. | |
| 6,236,024 | B1 | | 5/2001 | Gotz et al. | |
| 6,316,753 | B2 | | 11/2001 | Clothier et al. | |
| 6,320,169 | B1 | | 11/2001 | Clothier | |
| 6,444,958 | B1 | | 9/2002 | Campbell | |
| 6,528,770 | B1 | | 3/2003 | Akel et al. | |
| 6,528,772 | B1 | | 3/2003 | Graves et al. | |
| 6,548,894 | B2 | | 4/2003 | Chu et al. | |
| 6,555,794 | B2 | | 4/2003 | Leutner et al. | |
| 6,600,139 | B2 | * | 7/2003 | Perschl et al. | 219/460.1 |
| 6,630,650 | B2 | | 10/2003 | Bassill et al. | |
| 6,639,190 | B2 | | 10/2003 | Lerner | |
| 6,660,980 | B2 | | 12/2003 | Nagata et al. | |
| 6,660,981 | B2 | | 12/2003 | Ogata et al. | |
| 6,737,617 | B1 | | 5/2004 | Daum et al. | |
| 6,770,857 | B2 | | 8/2004 | Hirota et al. | |
| 6,821,628 | B2 | | 11/2004 | Schultheis et al. | |
| 6,828,530 | B2 | | 12/2004 | Boegel et al. | |
| 6,956,188 | B2 | | 10/2005 | De Rooij et al. | |
| 7,049,552 | B2 | | 5/2006 | Arntz et al. | |
| 7,049,563 | B2 | | 5/2006 | Keishima et al. | |
| 7,081,603 | B2 | | 7/2006 | Hoh et al. | |
| 7,102,109 | B2 | | 9/2006 | Niiyama et al. | |
| 7,423,244 | B2 | | 9/2008 | Baier et al. | |
| 2002/0063327 | A1 | * | 5/2002 | Chu et al. | 257/706 |
| 2004/0000543 | A1 | | 1/2004 | Dudek et al. | |

OTHER PUBLICATIONS

*Designed for the Everyday Chef, Induction Cooking Innovation from Kenmore ®*, US.

*Research on Required Exhaust Flow Rate in Commercial Kitchens in the Case of Gas-Fired and Induction-Heating Cooking Equipment,* OSAKAGAS Technical Sheet, website www.osakagas.co.jp/rd/sheet/061e.htm, Japan.

*Induction Cooktops,* Australian Consumers' Association website www.choice.com.au, Australia.

*The Induction Hob Class Induction Technical Training,* Brandt Customer Services Formation CU3-Induction-002UK-02/03, 2003, ElcoBrandt training manual, France.

*10-Bit Rotary Encoder IC Supplants Optical Encoder,* Electronic Products 29th Annual Product of the Year Awards, Jan. 2005, US.

Flexpoint Flexible Sensor Systems Inc., Multi-Purpose Bend Sensors® product specification, US.

Induction Cooktops Installation Guide; Kleenmaid; updated May 2005.

Installation Instructions for Induction Cooktop; Thermador; © BSH Home Appliances Corporation 2005.

Installation Manual for Cooktop; Bosch; © BSH Home Appliances Corporation.

* cited by examiner

INDUCTION COOK TOP WITH HEAT MANAGEMENT SYSTEM

CROSS REFERENCE TO RELATED APPLICATIONS

This application claims priority from U.S. Provisional Patent Application Ser. No. 60/888,080, filed on Feb. 3, 2007, the entirety of which is expressly incorporated by reference herein.

BACKGROUND OF THE INVENTION

1. Field of the Invention

The present invention pertains to the art of induction cooking appliances and, more particularly, to an induction cook top appliance with a heat management system.

2. Discussion of the Related Art

Induction cooking, though long a favorite method of cooking in other parts of the world, has only recently become popular in the United States due to its high energy efficiency. Further, induction cooking is more efficient than gas or radiant heat because the cooking elements, i.e., electromagnetic coils, or hobs, are powered by induction generators that induce high levels of current in a pot placed on the cook top, thus heating the pot because of its high electrical resistance. The food or liquid in the pot is heated more quickly because very little heat is lost around the sides of the pot, i.e., the vast majority of heat is transferred directly to the contents of the pot.

During induction cooking the heated pot may radiate heat down into the chassis or housing of the cook top, which can be of the drop in or slide in design as well as free standing. Often times, some type of internal ventilation system is used to evacuate the air in the chassis either upwards through venting slots above the cook top or counter or downward into the cabinet.

Typically, the internal components in the main housing are cooled by moving the heated air out of the housing. However, existing cooling systems do not account for the temperature of the incoming air, i.e., the systems are directed towards air removal from the inside the housing without considering the surrounding air temperature. Further, many existing systems re-circulate the previously expelled heated air back into the housing cavity, thereby increasing the temperature inside. This may result in elevated temperature levels in the housing that may cause component failure and/or reduced cooking performance.

The prior art primarily is directed to controlling the operation of an internal electric fan for cooling the induction heating cooking apparatus, but it fails to address the flow of ambient air outside the housing.

For example, U.S. Pat. No. 4,549,052 discloses an internal cooling system for an induction cooking cartridge. This system includes an internal fan for cooling the various induction heating components. The cooking cartridge features an airflow that enters a mounting recess in at least two areas and enters at both the top and bottom of the cartridge cavity. The airflow is directed over the induction heating circuitry for cooling and is exhausted through the fan to an exhaust conduit. However, this system does not address the issue of the surrounding air intake and the temperature or quality of the air that is brought back into the housing for cooling.

U.S. Pat. No. 4,191,875 is directed toward controlling an internal electric fan for cooling an induction heating apparatus. A thermistor is located near the induction heating apparatus and controls the operations of a fan. The thermistor is in series with a variable resistor and a capacitor. When the capacitor is charged to a predetermined voltage through the thermistor and variable resistor it will fire a signal through a component to allow current to flow through an electronic component and operate the fan motor. This system also includes a plurality of air inlets and outlet holes in the walls of the housing so that the fan randomly pulls air in one side and exhausts out the other side of the housing after passing over the induction heating apparatus. However, this system relies upon the critical factor that the airflow must be undisturbed in cooling.

U.S. Pat. No. 4,415,788 describes an induction cartridge having an internal forced air cooling system where a fan draws air into the cartridge cavity, circulates it around the induction heating components and exhausts it out an opening in the bottom of the cartridge. This patent discloses exhausted air being returned to the kitchen environment through an exhaust gap around the periphery of the cartridge between the housing top and the bottom of a support flange. It is also stated that to protect the air stream that a separate drop in cartridge be made that isolates the induction elements from any other source of blockage.

In another example, U.S. Pat. No. 4,431,892 discloses an induction cook top as a cartridge being fitted into a recess in a housing. The main innovation is an attempt to ventilate the interior of the cartridge using a ventilation system housed in the main body. The cartridge has openings on the side and top for air to pass through once connected to the holes in the down draft ventilator. However, this design is flawed because air that is drawn in will take the path of least resistance, i.e., the air would not be drawn effectively from the cartridge. Without proper air flow, the generator in the induction cartridge would overheat which may result in component failure or destruction.

In U.S. Pat. No. 4,415,788, an induction hob cartridge contains a fan integrated into the hob assembly for cooling the electronics. The problem with this design is that the cartridge does not take into account the exhausted air or the air that is brought into the system. Specifically, the heated air is exhausted out the top edges and may be drawn back into the unit.

In U.S. Pat. No. 4,100,964, an induction ventilation system featuring a liquid cooling system for removal of heat is disclosed. This system can be large, complex and takes up large amounts of space. Moreover, this system does not treat the incoming air. Thus the exhausted heated air may be returned back into the cavity of the housing.

In U.S. Pat. No. 4,549,052, an induction hob cartridge contains a fan integrated into the hob assembly for cooling the circuitry. This design does not take into account where the air is exhausted and the potential of drawing the exhausted air back into the cavity. Specifically, the heated air is exhausted out the top edges and may be drawn back into the unit if the exhausted air is not moved away from the intake vents for the cartridge.

Therefore, there exists a need for a state of the art indoor or outdoor induction cook top with heat management system to control the heat generated by the components, electronic controller, mechanical controls, or the induction generators, providing precise temperature control and efficient heat removal without drawing exhausted air back into the system. Further, there exists a need for an induction cook top having a smaller depth for ease of extraction and no venting above the counter. There exists a need for the user to be able to view/see the operation, functions, and view the codes on the cook top. There also is needed a new cook top construction such that it can be used in limited spaces and places. Finally, there is also a need for a proper vent design so as to efficiently remove undesired heated air from the housing of an induction cook top appliance.

SUMMARY AND OBJECTS OF THE INVENTION

The present invention relates to an indoor or outdoor induction cook top with a heat management system that a) controls the heat generated by the electronic controller, mechanical controls, and the induction generators, as well as the radiated heat for the cooking, and b) provides precise temperature control, efficient removal of heated air, and improved air flow through the system. More particularly this invention relates to an improved induction cook top having better accuracy in removing heated air and directing airflow with precise control of ventilation functions/operations in built-in, mobile or modular appliances. Sensors may also be utilized to provide users with information pertaining to system conditions, e.g., the temperature in the housing. The induction cook top of the present invention further provides greater efficiency and lower noise levels.

In accordance with one aspect of the invention, an induction cook top appliance comprises a cooking surface attached to a housing, wherein the housing has an intake opening and an exhaust opening, an inductor coil in the housing and below the cooking surface, an induction generator operatively connected to the inductor coil, a fan for moving air through the housing, an electronic control system that controls the fan, and a barrier system attached to the housing that is configured to prevent heated air that passes through the exhaust opening from being drawn back into the housing through the intake opening.

In accordance with another aspect of the invention, an induction cook top appliance comprises a cooking surface attached to a housing, an inductor coil in the housing and below the cooking surface, an induction generator operatively connected to the inductor coil, an electronic cooling device, and an electronic control system in communication with the fan and the electronic cooling device.

In accordance with a still further aspect of the invention, an induction cook top appliance comprises, a cooking surface attached to a housing, an inductor coil in the housing and below the cooking surface, an induction generator operatively connected to the inductor coil, a through-mounted thermoelectric cooling device attached to the housing; and an electronic control system in communication with the thermoelectric cooling device.

Additionally, the invention may include one or more fans for moving air throughout the housing and/or for moving heated air away from the housing. Further, the invention may include a housing that is sealed to substantially prevent air from escaping the housing. Still further, the invention may be used in conjunction with a downdraft ventilator, e.g., a stationary or telescoping downdraft ventilator.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

Figure 1:
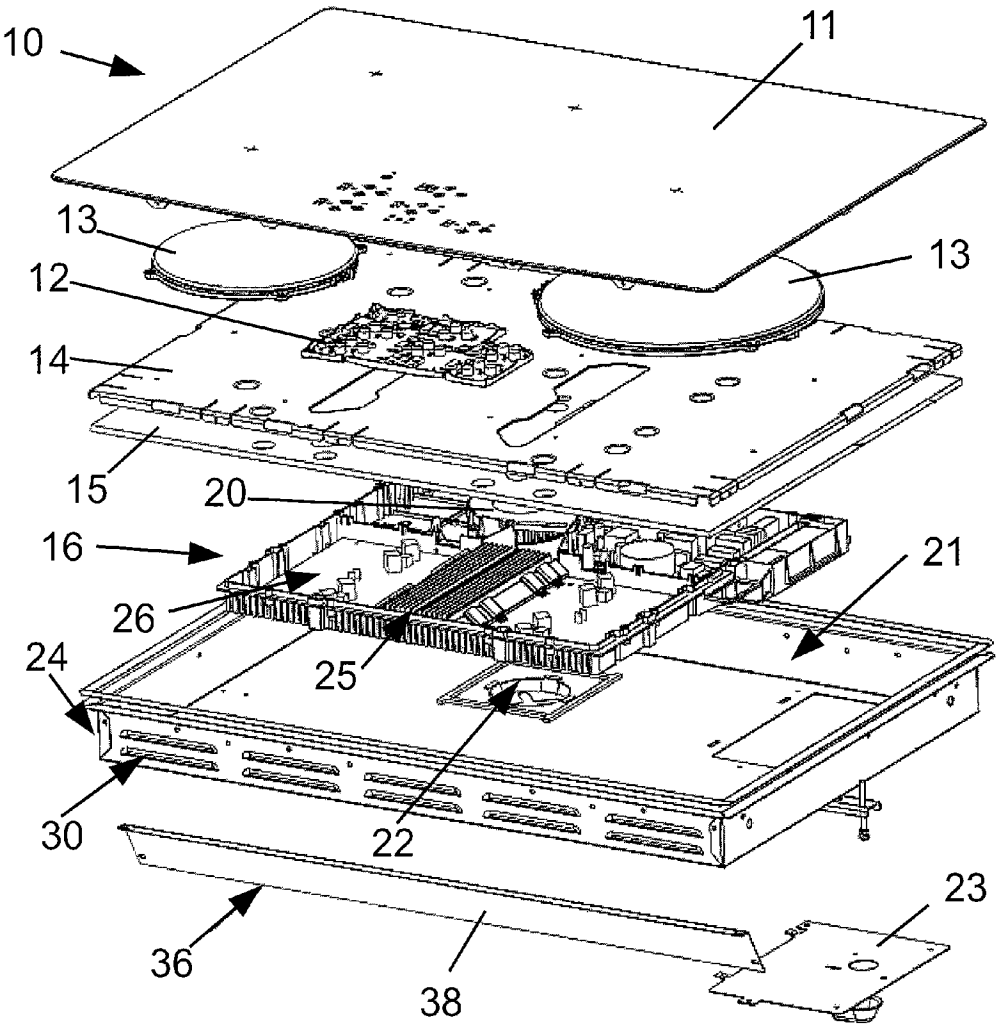
FIG. 1 is a perspective view of one embodiment of the cook top of the present invention.

In describing the preferred embodiments of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word "connected", "attached", or terms similar thereto are often used. They are not limited to direct connection but include connection through other elements where such connection is recognized as being equivalent by those skilled in the art.

DESCRIPTION OF PREFERRED EMBODIMENTS

The present invention and the various features and advantageous details thereof are explained more fully with reference to the non-limiting embodiments described in detail in the following description.

Note that the detailed description that follows the drawings, which are used, do not show all the details of every product described, but only certain features of the invention that aid in describing the invention. One skilled in the art will see the benefits of this new invention and know of all the other methods of construction and design.

1. System Overview

The present invention relates to an indoor or outdoor induction cook top having a heat management system and system heat control. Briefly, this is accomplished by providing an induction cook top with the a system to control and efficiently remove the heat generated by the electronic controller, mechanical controls, and the induction generators of the cook top while also providing precise temperature control and an efficient way of removal of heat. Further, also disclosed is a cook top having a closed system, e.g., wherein the housing is sealed to substantially prevent air from escaping the housing. The inventive induction cook top can be combined with other countertop range items in the house, thus eliminating the need for an above-counter venting system.

With the increasing heat dissipation from induction devices and the reduction in overall form, thermal management has become a much more important element of electronic product design in induction appliances. Both the performance reliability and life expectancy of the induction cook tops are inversely related to the component temperature of the equipment. The relationship between the reliability and the operating temperature of an induction generator and the electronic controls devices shows that a reduction in the temperature corresponds to an exponential increase in the reliability and life expectancy of the devices. Long life with increased reliable performance of a component may be achieved by effectively controlling the device operating temperature within the limits set for these components.

The system preferably incorporates an air flow diverter system or barrier system which prevents exhausted, heated air from having a direct path to the intake opening in the housing of the cook top. Thus, this prevents the heated air from recirculating through the system and thus increasing the temperature in the system.

2. Detailed Description of Preferred Embodiments

With reference to the present invention, FIGS. 1-11 shows possible designs of an indoor or outdoor induction cook top having a heat management system and systems heat control. This disclosure describes the integration of a smooth glass ceramic induction cook top, a heat management system and the components required to overcome the inadequacies of other designs on the market.

The heat management system can be incorporated with a telescoping ventilator integrated into the smooth glass ceramic induction cook top for removal of contaminated air without affecting the airflow. Directing the heated air is crucial to maintaining uniform flow throughout the housing while maximizing the total air flow rate through the system. This helps to maintain generally uniform temperatures of the internal components regardless of the ambient air temperatures. This system can also incorporate a cross flow or centrifugal blower system.

The system preferably includes an electronic control system, which preferably communicates with sensors to monitor conditions, e.g., temperature, within the housing and makes adjustments accordingly, e.g., changing the fan speed or controlling an electronic cooling device. The electronic controls may be located within the housing, attached to the housing, or they may be remote from the housing, thus isolating the electronic controls from exposure to any increased temperature.

Figure 2:
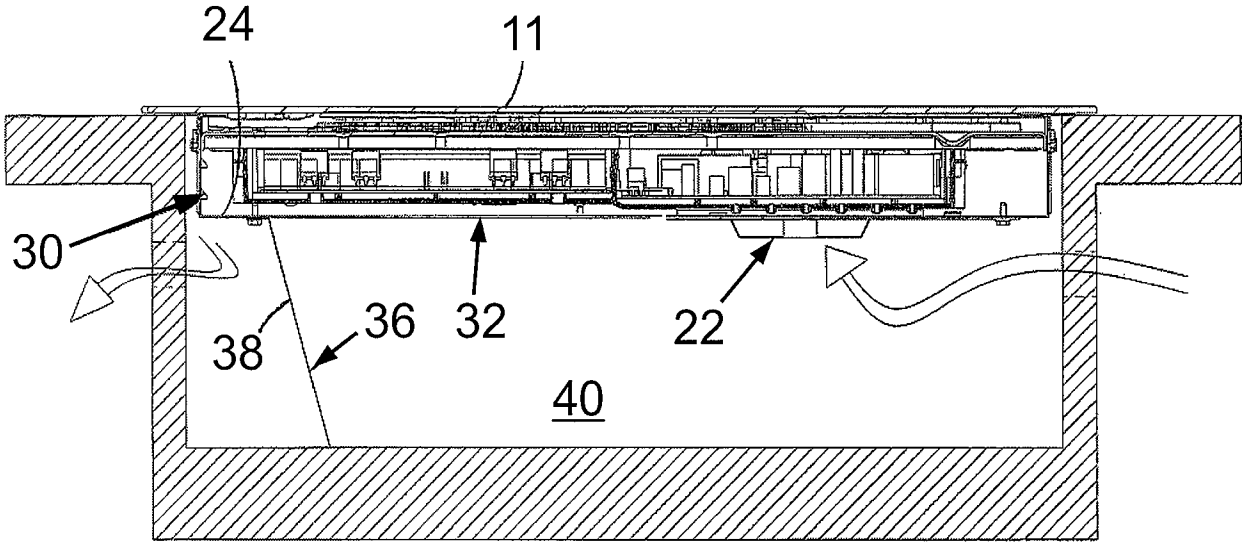
FIG. 2 is a side view of the embodiment of FIG. 1.

Referring to FIGS. 1-2, a first preferred embodiment of an induction cook top 10 is shown. The induction cook top 10 preferably is comprised of a ceramic glass cooking surface 11, a touch board 12, inductor coils or induction hobs 13 located between the cooking surface 11 and a metal top plate 14, an insulating material 15, and an induction generator electronics assembly 16 assembled in a cavity 21 and mounted to a chassis or housing 24. The electronic control system is in communication with various components, e.g., a fan 20, induction generators 26, a heat exchanger 25, and may be located on the touch board 12. The housing 24 further comprises an air intake vent 22, access panel 23 and outlet vents 30. The generator electronics assembly 16 preferably further comprises induction generators 26, the fan 20 and the heat/cooling exchanger 25. The fan 20 pulls ambient cooling air into the cavity 21 from the intake vent 22 and through heat/cooling exchanger 25. Cooling is important due to the increasingly larger Watt output of induction generators 26 and the large amount of heat generated from the appliance/hobs 13.

The induction cook top 10 of FIGS. 1-2 may have vent slots 30 below the counter for venting heat out of the housing 24. The air intake 22 may be located at the front or back of the bottom 32 of the housing 24, but preferably the air intake 22 is located opposite the venting slots 30. The intake 22 and slots 30 preferably are in communication with vents in a stand, cabinet or island that supports the cook top. Thus, intake 22 and slots 30 can draw air from the outside.

As shown in FIGS. 1-2, incorporating an airflow barrier system, e.g., a baffle, strip or barrier 36, onto the bottom 32 of the cook top housing 24 prevents exhausted air from recirculating back into the cavity 21 where the hobs 28 are located, thereby preventing an increase of the temperature inside the housing 24. Multiple barriers 36 or vents 30 or alternative arrangements could be utilized. For example, the intake 22 of each fan 20 could be individually ducted or separated by barriers 36. The exhaust from multiple fans 20 could also be ducted or guided by barriers 36. The positioning of the barrier may vary, but preferably it is angled toward the intake 22, as shown in FIG. 2.

The airflow barrier system 36 mounted to the induction cook top housing 24 may prevent exhausted heated air from having a direct path back to the intake 22. More specifically, the barrier 36 extends downwardly and blocks the airflow from the exhaust 30. One type of barrier 36 could be a flip down barrier on the bottom of the housing such that the barrier 36 can be folded up against the bottom 32 to provide a flat profile for shipping. This type of barrier 36 permits the barrier 36 to be adjustable to the depth of the area below the housing 24. Such adjustment capability provides the flexibility to install the cook top 10 in any cabinet and can provide for the varying depths or restrictions found in cabinets or locations. Alternatively, the barrier 36 may be a fixed or flexible barrier attached to the bottom 32 of the housing 24. The barrier 36 may also be a detachable barrier that attaches to the bottom 32 of the housing 24. In this case, the barrier 36 may be removed for shipping and installed during installation of the cook top 10.

The barrier 36 can be attached by any suitable means including, but not limited to, screws, hinges, slots, adhesive or tape. The construction and design of the embodiment of FIGS. 1-2 address the known deficiencies of presently available induction cook tops that permit air to circulate back into the induction cook top housing 24 and increase the temperature levels therein.

Further, it should be noted that although a touch pad control is disclosed, electronic or mechanical knob controls could also be used as user interfaces.

Figure 3:
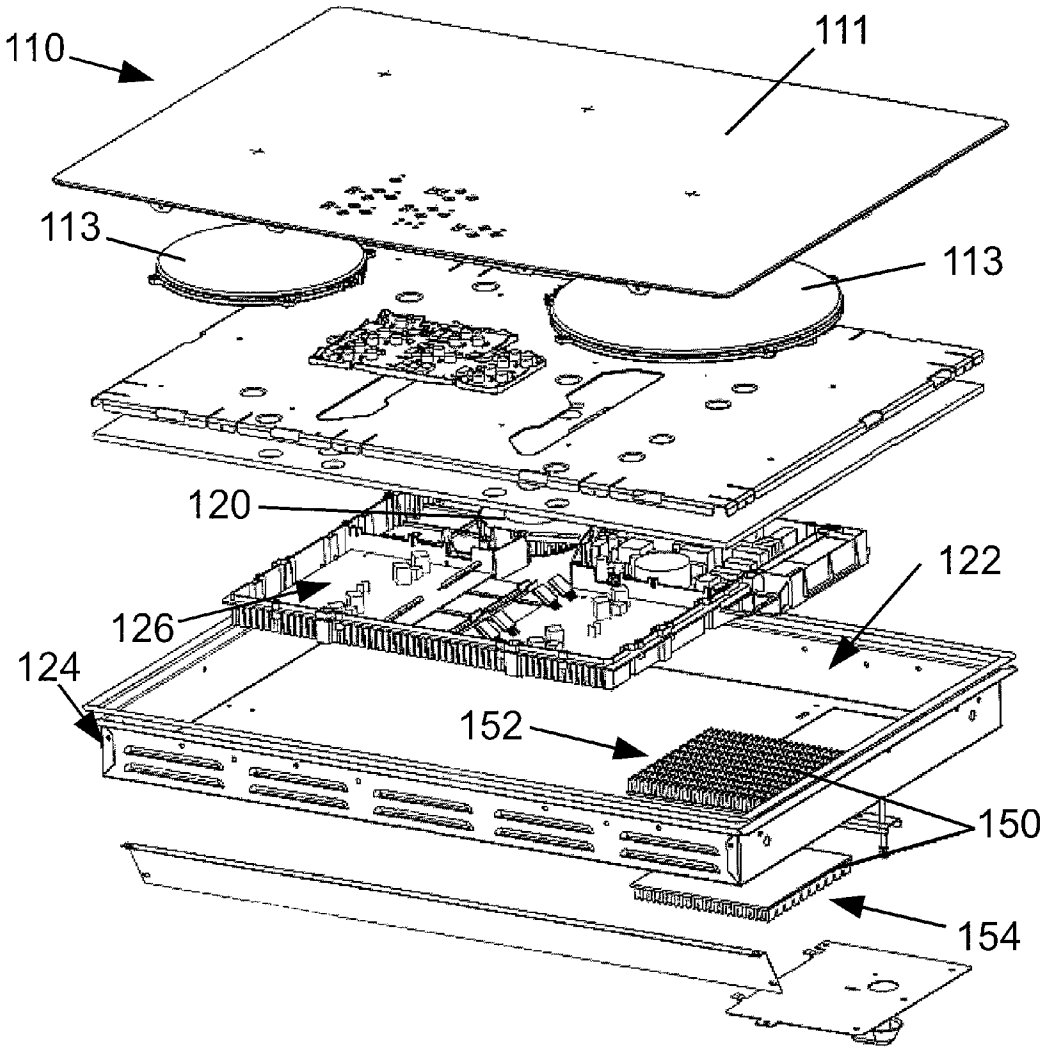
FIG. 3 is a perspective view of another embodiment of the cook top of the present invention.
Figure 4:
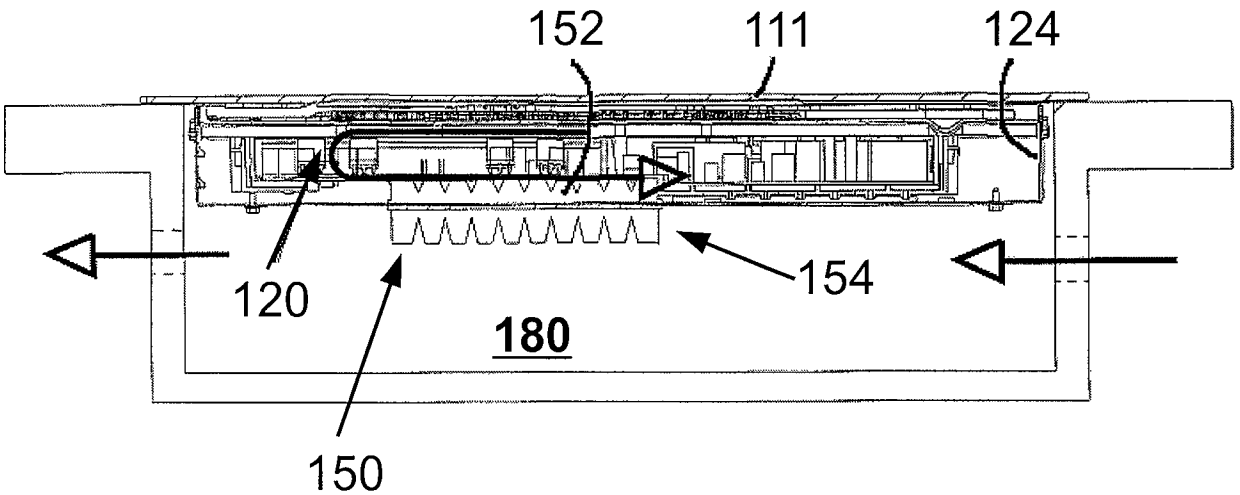
FIG. 4 is a side view of the embodiment of FIG. 3.
Figure 6:
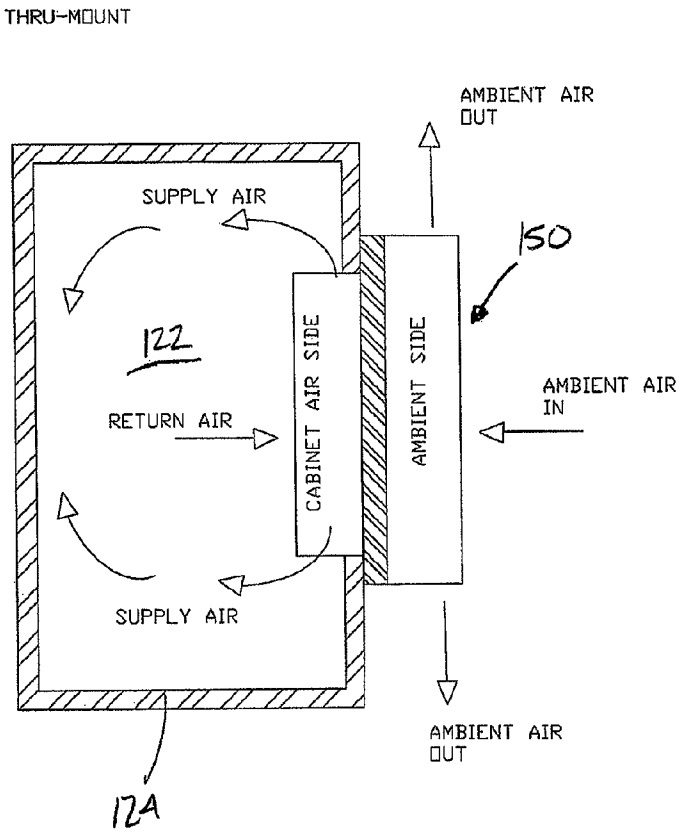
FIG. 6 is a view of the airflow pattern in an embodiment of the invention featuring a through-mounted electronic cooling device.
Figure 5:
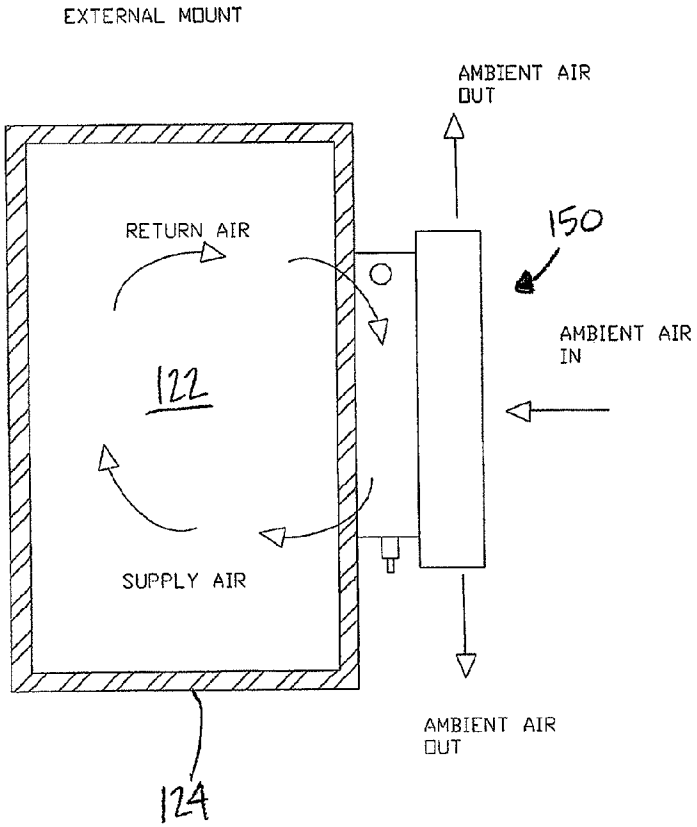
FIG. 5 is a view of an airflow pattern in an embodiment of the invention featuring an externally mounted electronic cooling device.

Referring to a second preferred embodiment of the inventive induction cook top shown in FIGS. 3-4, an electronic cooling device 150 is used to provide cooling to an induction cook top 110. The electronic cooling device 150 may be any suitable device, e.g., a forced convection cooler, an electronic heat sink, brazedgain convergence, a thermoelectric cooling device, a cold plate or plates, electronic heat pipes, a copper spreader, thermal vias or a low profile electronic fan heat sink. Preferably, the electronic cooling device 150 is a thermoelectric cooling device, which operates by the Peltier effect whereby heat is transferred via the flow of current through a thermoelectric device 150. A first portion 152 (i.e., the "cold side") of the thermoelectric device 150 absorbs heat in the housing 124, thereby reducing the temperature. A second portion 154 (i.e., the "hot side") dissipates the heat into the ambient air, typically the under counter space 140. Forced air fans 158, 160 may be used to move the air over both the hot side 152 and cold side 154 of the thermoelectric device 150. The thermoelectric device 150 has no moving mechanical parts so they are extremely reliable with an almost unlimited life span. No maintenance is required, except for the fans. Static construction makes the thermoelectric device 150 immune to vibration thus allowing it to be placed in any orientation. A thermoelectric heat device 150 does not contain any CFC or other gases and has a compact and simple structure. The preferred cook top 110 contains one or more thermoelectric devices 150. As shown in FIGS. 5-6, the electronic cooling device may be mounted externally to the housing, see FIG. 5, or through-mounted. See FIG. 6.

Figure 7:
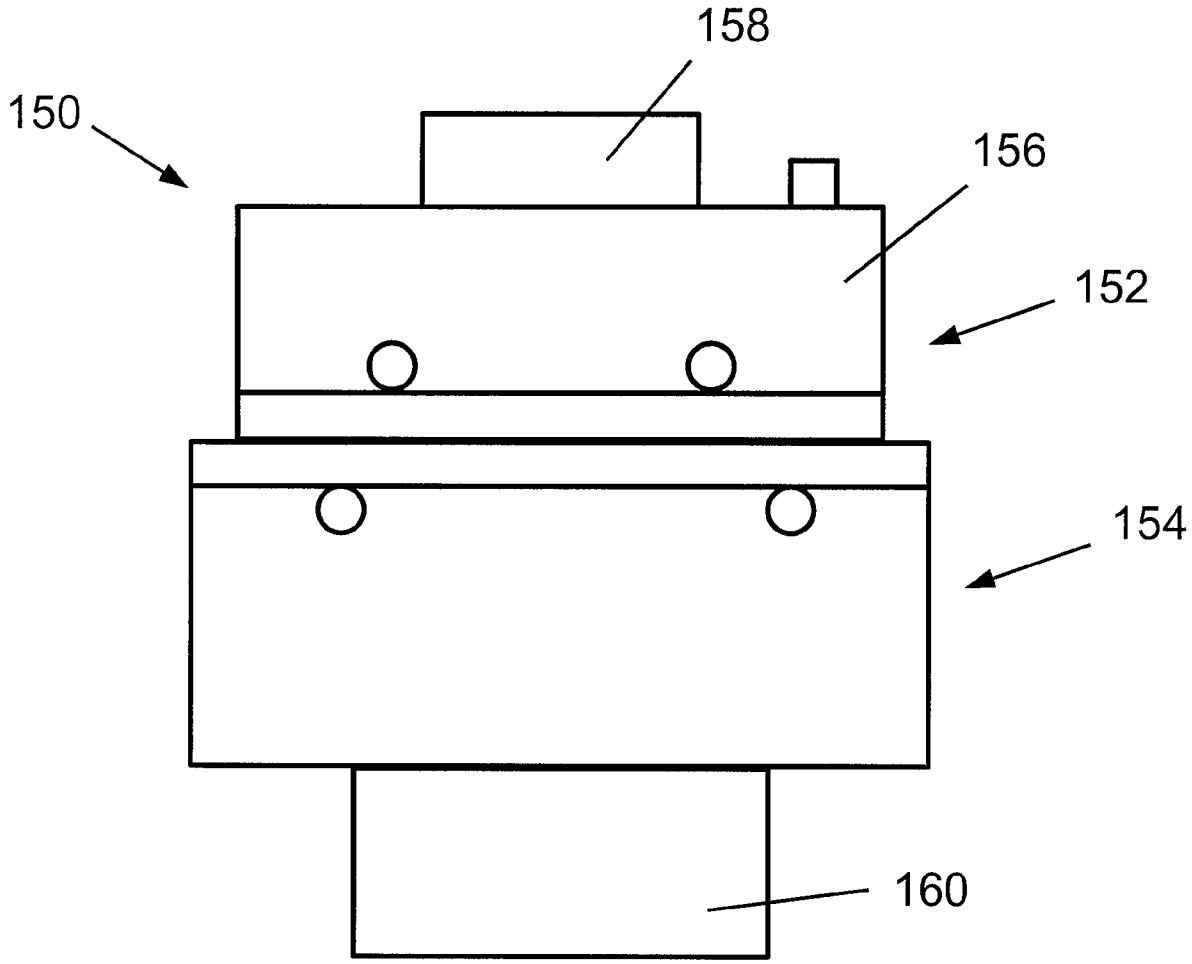
FIG. 7 is a side view of an electronic cooling device that may be used with the cook top of the present invention.

A preferred electronic cooling device 150 is a through-mount thermoelectric device produced by Melcor, model number MAA600T-24. See FIG. 6 for an example of a through-mounted electronic cooling device. Alternatively, a unit produced by INB Thermoelectric Products could be utilized. As shown in FIG. 7, the cold side 152 of the module 150 is connected to a heat sink 156 with a fan 158 for forced convection that absorbs heat from within the enclosure 124 while circulating the cooled air. The warm or hot side 154 of the thermoelectric device 150 may be connected to the same fan or another forced convection fan 160 that dissipates the heat absorbed through the cold side 152 as well as the input power to the module or modules to the ambient. This thermoelectric device 150, or TEC, is a solid-state heat pump that utilizes the Peltier effect to provide cooling. The assembly components are comprised of: a p-type semiconductor, an n-type semiconductor, an electrical insulator (ceramic or other non conductive material types), electrical conductors (copper) and two lead wires (one negative (−) and one positive (+) lead wire connected to the assembly to provide current to this assembly). Thermoelectric devices have only recently become practical for this application due to the development of the semiconductor thermocouple materials stated above. The use of bismuth telluride, a quaternary alloy of bismuth, tellurium, selenium and antimony, doped and processed to yield oriented polycrystalline semiconductors with anisotropic thermoelectric properties are preferably used. Other materials are being developed for this type of cooling with the ability to change current flow and provide heating.

With the use of an electronic cooling device 150, e.g., a thermoelectric cooling device, a closed loop system may be used to keep the internal cabinet air isolated from the heated ambient air. The removal of external fans would decrease the noise level of the cook top 110. Some of the features of the thermoelectric device 150 are: cooling to 78° F. below ambient, maintaining ambient temperatures while removing up to 640 BTU/Hr in the housing 124 and precision temperature control. As stated, an electronic cooling device 150 eliminates the exchange of air between the housing 124 and the ambient air space 140. Additionally, multiple electronic cooling devices 150 may be arranged, e.g., cascaded, to provide greater cooling if needed. This is especially important given the projected demand for higher wattage output from the induction hobs 113. Burner elements having at least 5,000 Watts and up to 9,000 Watts output are anticipated in future generations of induction cook tops, resulting in a significant increase in heat generated by the hobs 113.

In another embodiment, the bottom 32 of the housing 24 may be connected with thermoelectric wiring so that the bottom 32 may function as a cooling plate. In such a configuration, the internal fan for circulating cool air throughout the housing 24 may be eliminated. However, it is still preferably to have an external fan for moving heat away from the housing 24.

In sum, the embodiment of FIGS. 3-4 is an induction cook top 110 that uses an electronic cooling device 150. Electronic forced air-cooling systems such as the thermoelectric device 150 provide compact, lightweight, cooling systems for enclosures in harsh environments. These air-to-air exchangers are relatively new to the market and have only been used for certain applications, e.g., cooling computers. Recent developments in the field of semiconductor thermocouple materials have made these devices more practical. Electronic cooling devices have no moving parts and only need a fan 120 to force cooled air into the induction cook top housing 124. Electronic cooling devices 150 are extremely reliable and provide an extended life span for the cook top 110.

In another embodiment, an external electronic forced air cooling blower system may be synced with the operations of the electronic control system when operating the appliance 110. The electronic control system responds by turning on the thermoelectric device 150 without user interaction. The electronic cooling device 150 may remain on until proper levels and/or temperatures are reached, even after the cooking unit is turned off. As stated, thermoelectric devices 150 provide low noise level. Thus, because the thermoelectric device 150 is externally mounted, the main housing 124 noise is substantially reduced. These devices provide precision temperature control, quick cooling to below ambient temperatures, reduced space, size and weight, reliable solid-state operation with no sound or vibration, and can also provide heating. The devices can be mounted by many methods and is not limited to the single description given here.

As shown in FIG. 7, the electronic cooling device 150 in one embodiment may be equipped with one or more fans 158 to help move cooled air through the housing and heated air away from the cook top. The fans 158 may be secured to the housing 124 using any suitable fastener, e.g., bolts, screws, adhesives, rivets, and clips. In this arrangement, the thermoelectric device 150 provides cooling air inside the housing 124 and removing the heat at the bottom. Thus, using a thermoelectric device may eliminate the need to exhaust of air from the housing 124, thereby eliminating the need to vent air out through slots.

As discussed in further detail below, sensors having the ability to detect temperature and backpressure in the exhaust stream may be used in conjunction with the cook top of the present invention. If a blockage or extreme heat is sensed in the house discharge vent, the sensor may communicate with the electronic control system to increase fan speed to maintain the proper volume of extraction and thus overcome the increased heat load. This prevents the shut down of and/or damage to the generators 126 and exposure of the electronics to excess heat generated, and it also preferably keeps the cooking surface at a lower temperature. Many types of sensors may be used for detecting and controlling the speed of the forced air-cooling fan/blower supplying cooled air to the housing 124. For example, airflow sensors can be used for detecting the proper temperature of the flow of air internal in the cavity 122 of the induction housing 124. Such a sensor measures the airflow and provides a signal to the electronics to increase or decrease the cooling air to maintain a desired temperature, i.e., a temperature that cools the generators and other components while providing increased efficiency of the induction hobs 113.

Figure 8:
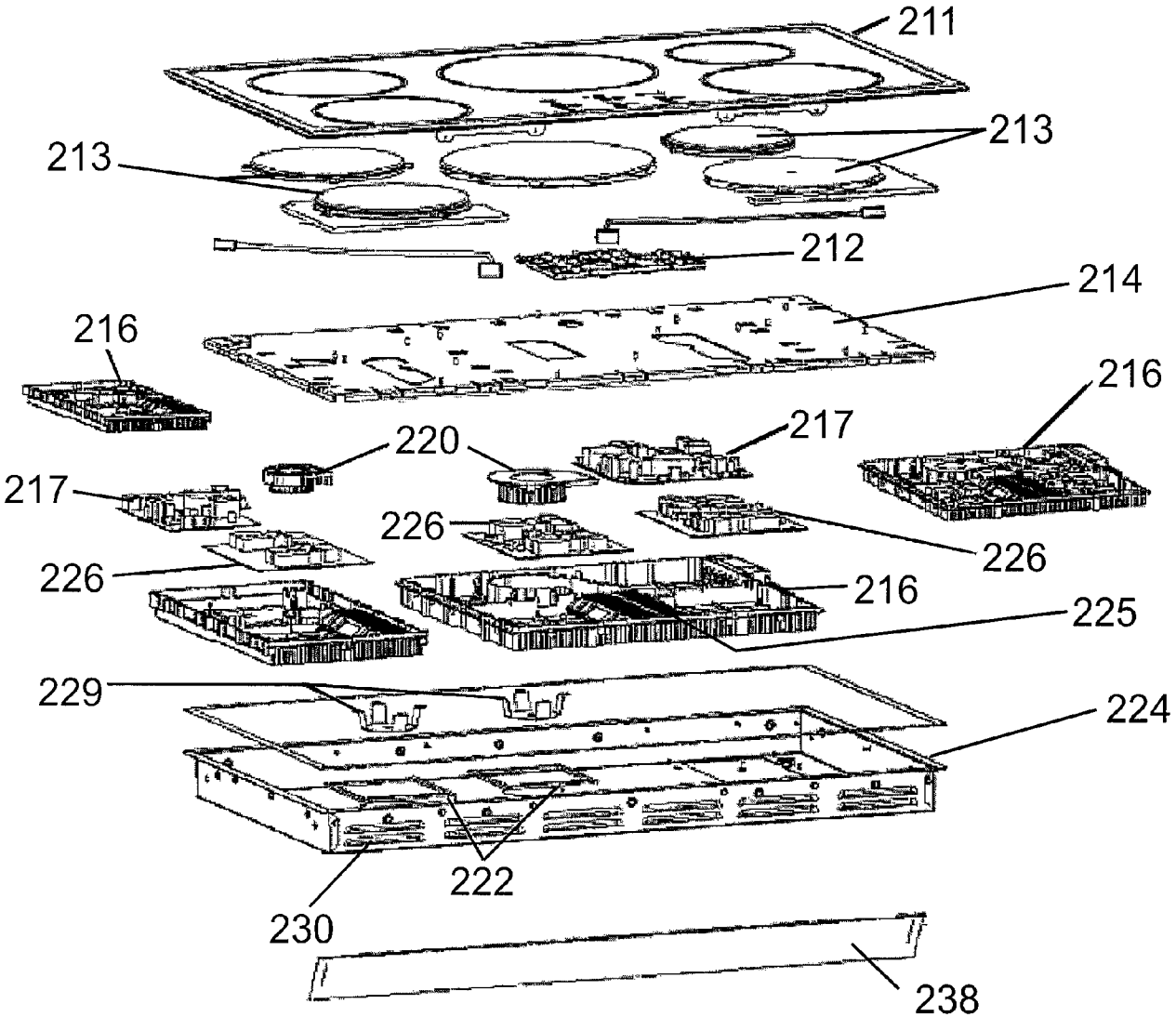
FIG. 8 is a perspective view of another embodiment of the cook top of the present invention.

Another possible embodiment of the cook top of the present invention includes the embodiment of FIG. 8. The preferred dimensions for the cook top shown in FIG. 8, which preferably contains five hobs 213, are as follows: the glass surface having a length of about 36 inches and a width of about 30 inches, the housing having a length of about 34 inches and a width of about 19 inches. However, these dimensions may vary as desired.

The embodiment of FIG. 8 has a housing 224 with two intake vents 222 on the bottom of the housing 224 and a series of outlet vents 230 in the sidewall of the housing 224. The housing contains two induction generator electronic assemblies 216, each of which comprises a fan 220, at least one induction generator 226, a heat exchanger 225 and a filter board 217. The fan 220 may be fitted with a fan cover 229. The fans 220 preferably are positioned to align with intake vents 222, respectively. There is a metal top plate 214 positioned over the housing 224, and the inductor coils 213 are positioned between the metal top plate 214 and the cooking surface 211. Also between the metal top plate 214 and the cooking surface 211 is a touch board 212, which allows the user to control various operations of the cook top.

Below the housing 224, there is a barrier 238 that is positioned to substantially prevent heated air exhausted from the outlet vents 230 from being drawn back into the housing 224 through intake vents 222. The barrier 238 is preferably positioned so as to separate the intake vents 222 from the outlet vents 230. The barrier 238 may be integral with the housing 224, or it may be a separate piece attached using any suitable means, e.g., screws, bolts, adhesives, and glue.

Figure 9:
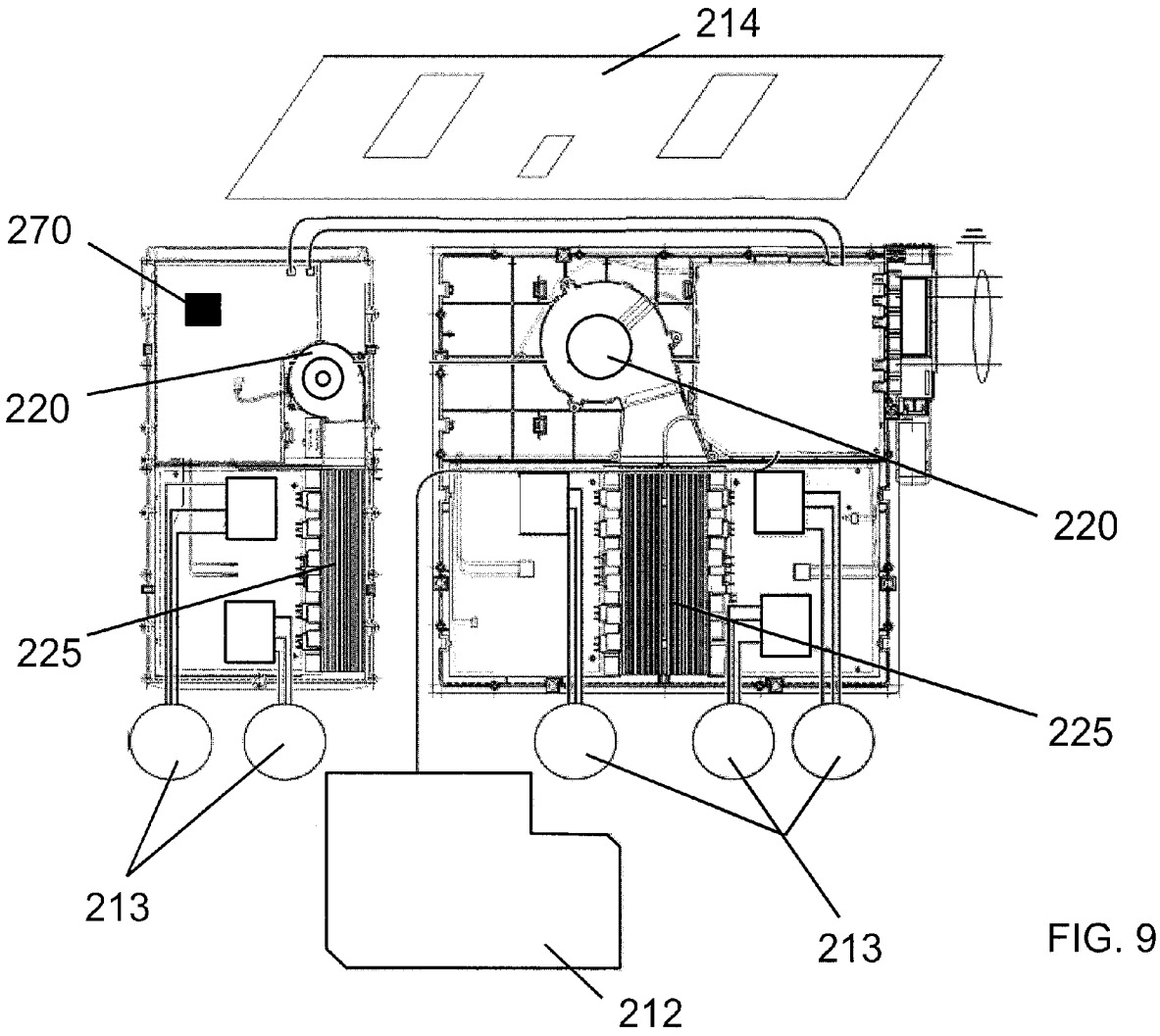
FIG. 9 is a schematic of an electronic control system that may be used with the embodiment of FIG. 8.

FIG. 9 is a schematic of an electronic wiring system that may be used in conjunction with the induction cook top of the present invention, preferably with the embodiment of FIG. 8. As shown in FIG. 9, the touch board 212 may house the electronic control system that controls the cook top. Additionally, there is a sensor 270 for sensing a condition within the housing that is in communication with the electronic control system, which may respond to the information provided by the sensor 270 accordingly, e.g., by turning on the fan 220 to cool the housing 224. The sensor 270 may be any one of a variety of sensors as discussed in further detail below.

Figure 10:
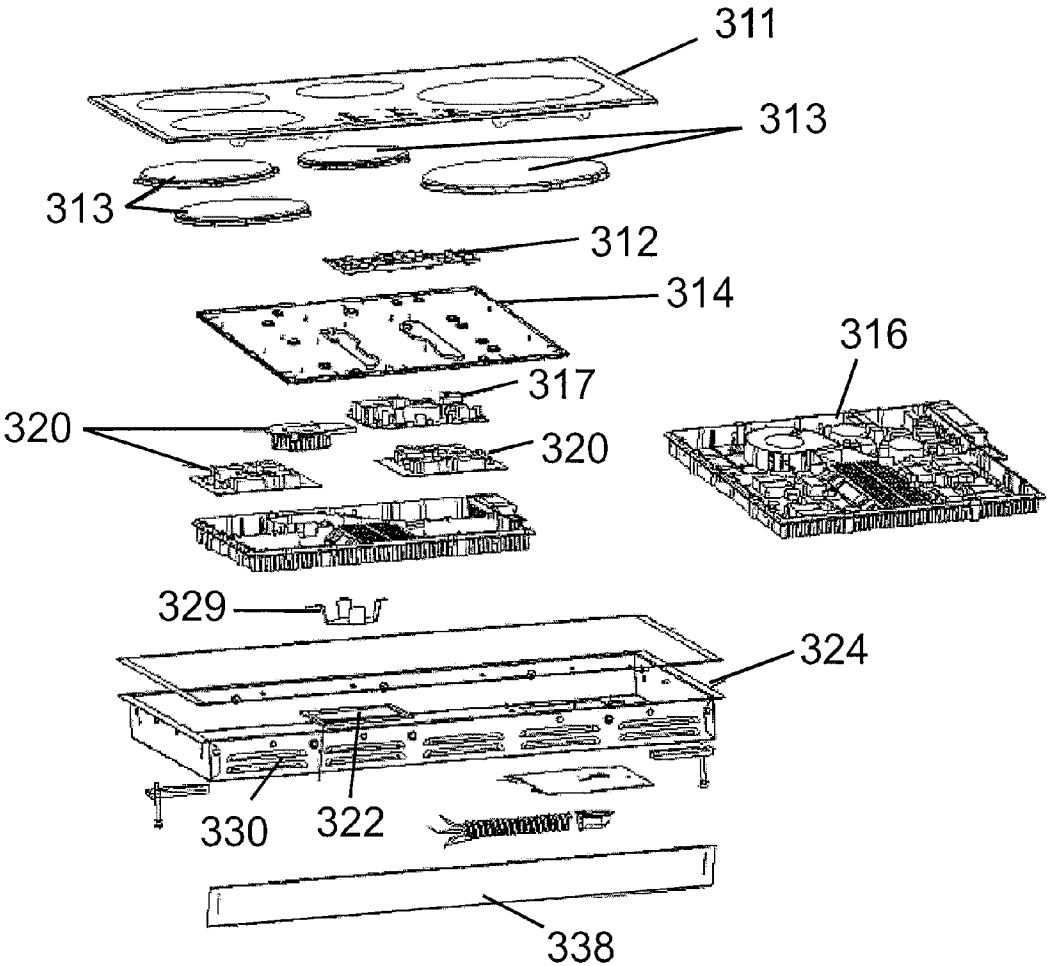
FIG. 10 is a perspective view of another embodiment of the cook top of the present invention.

FIG. 10 shows another embodiment of the cook top of the present invention, which preferably contains four hobs 313. The embodiment of FIG. 10 has a housing 324 with an intake vent 322 on the bottom of the housing 324 and a series of outlet vents 330 in the sidewall of the housing 324. The housing 324 contains an induction generator electronic assembly 316 that comprises a fan 320, at least one induction generator 326, a heat exchanger 325 and a filter board 317. The fan 320 may be fitted with a fan cover 329. The fan 320 preferably is positioned to align with intake vent 322. There is a metal top plate 314 positioned over the housing 324, and the inductor coils 313 are positioned between the metal top plate 314 and the cooking surface 311. Also between the metal top plate 314 and the cooking surface 311 is a touch board 312, which allows the user to control various operations of the cook top.

Below the housing 324, there is a barrier 338 that is positioned to substantially prevent heated air exhausted from the outlet vents 230 from being drawn back into the housing 324 through intake vents 322. The barrier 338 is preferably positioned so as to separate the intake vent 322 from the outlet vents 330. The barrier 338 may be integral with the housing 324, or it may be a separate piece attached using any suitable means, e.g., screws, bolts, adhesives, and glue.

Figure 11:
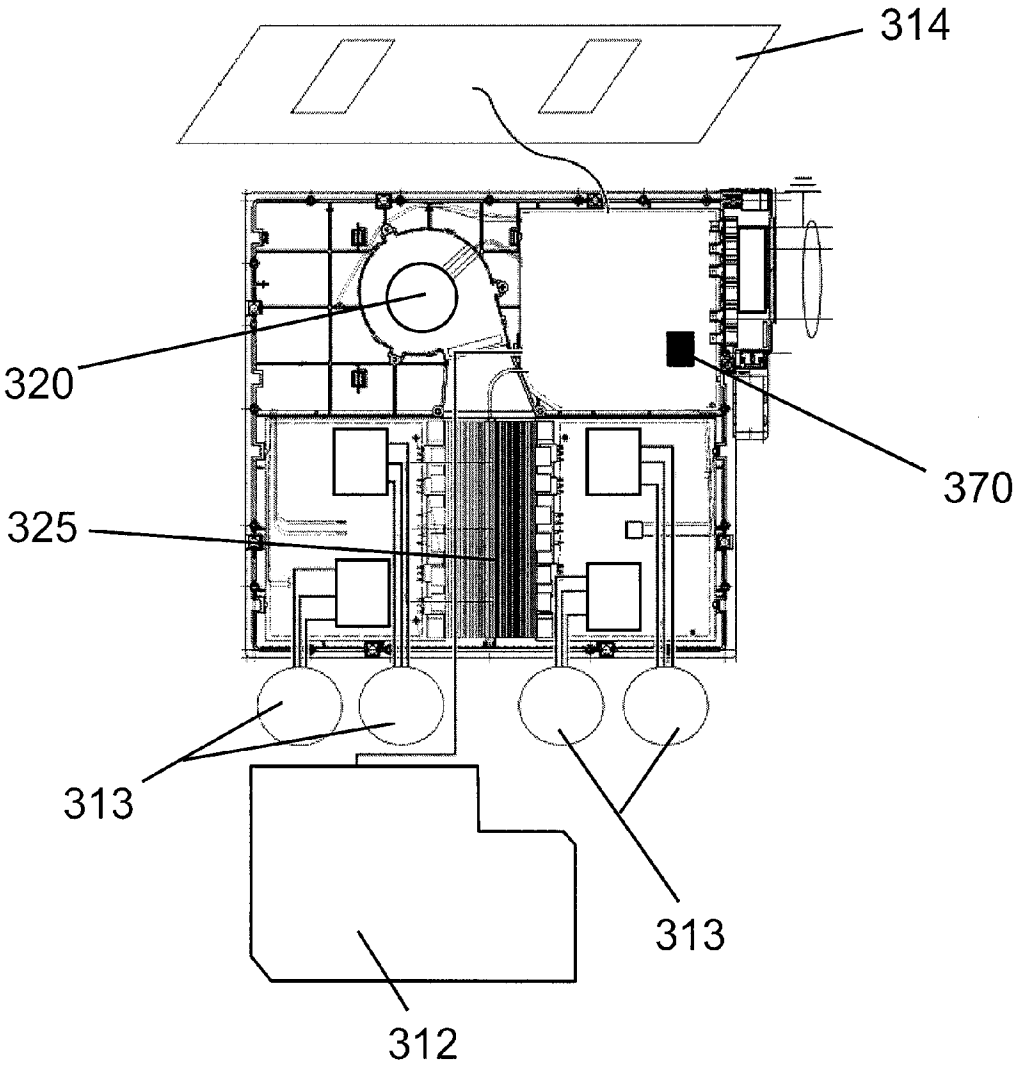
FIG. 11 is a schematic of an electronic control system that may be used with the embodiment of FIG. 10.

FIG. 11 is a schematic of an electronic wiring system that may be used in conjunction with the induction cook top of the present invention, preferably with the embodiment of FIG. 10. As shown in FIG. 11, the touch board 312 may house the electronic control system that controls the cook top. Additionally, there is a sensor 370 for sensing a condition within the housing 324 that is in communication with the electronic control system, which may respond to the information provided by the sensor 370 accordingly, e.g., by turning on the fan 320 to cool the housing 324. The sensor 370 may be any one of a variety of sensors as discussed in further detail below.

The induction cook top of the present invention may further include a user interface that is in communication with the electronic controls. Preferably, the user interface is an electronic touch pad, e.g., tactile, membrane, piezo, capacitance, resistance, induction, and electronic touch control. The user interface may be made of glass, metal or plastic.

Construction

With reference to the present invention, the embodiments discussed above use various technologies and principals of physics to control the heat generated by the electronic controller, mechanical controls, and the induction generators, provide precise temperature control and an efficient way of removal of heat over present induction cook tops on the market. Preferably, the embodiments use a smooth ceramic glass cook top. The induction hobs are preferably sandwiched in between the glass and a metal housing in any combination. The reduction of a number of components, the elimination of generated heat, the reduction of noise, an increase in performance are all features of both embodiments of the present invention. In a preferred construction the cook top is a drop-in cook top in a countertop without the need for venting above the counter. This invention generally provides the ability to pass the UL heat requirements tested in UL858, UL858A, or similar standards.

Construction materials both for the induction cook top components can range from metals, glass, stone, transparent materials, or man made materials. The preferred design for a bottom barrier 36 is made of a metal having thin thickness with a folded edge making a flap 38 for mounting to the bottom 32 of the housing 24. The flap 38 extends away from the housing 24, thereby blocking the airflow from the exhaust 30 and the intake 22 from having a direct path. Thus, the barrier 36 acts to substantially disrupt the exhaust air from re-entering the housing 24 and permits more cooling air to enter the intake 22.

Fixed or Telescoping Ventilator

With the induction cook top of the present invention, a fixed or telescoping down draft ventilator may be integrated into the smooth glass cooking surface. Examples of such ventilators are disclosed in U.S. Publication Nos. 2006/0278215 and 2007/0062513, which are expressly incorporated by reference herein. As one skilled in the art would appreciate with this invention, a downdraft ventilator would not affect the required airflow for cooling the induction generators, electronics, and cavity. Because of the various constructions, operating methods, and designs disclosed for the present invention, a limitless number of designs, features, appearances, elevations, styles, operations, sensing, and performances may be implemented for both fixed and telescoping down draft ventilators. With the ability to properly seal and isolate the downdraft air flow from the generator cooling air flow, the down draft may be placed in various locations and different configurations afford users the advantage and benefits offered by other product using fixed or telescoping down drafts. Thus, the downdraft ventilator could be any suitable shape or design, such as flush, telescoping, round, square or rectangular. Additionally, the ventilator system may be automatic (no user interface), semi-automatic (limited user interface) or manually controlled.

In addition to the drop-in style, the induction cook top system of the present invention may be a slide-in type cook top, with or without ventilators and/or telescoping units. The cook top of the present invention may be used in multiples, e.g., side-to-side or back-to-back, for large cooking areas, e.g., a large cooking island. The cook top further may be integrated into any free-standing range, barbeque, grill or other appliance. Further, it may be integrated into a cabinet, counter, island, wall or mobile unit. Such a system also may be constructed using materials such as metal, glass, stone or any variety of man made materials.

Forced Air Cooling System

In accordance with one aspect of this invention, an induction cook top is provided with a fan or blower and a cooling element, e.g., a thermoelectric device, in communication with the fan. The cooling element provides improved heat control to a non-ducted induction cook top secured to the inside of the cavity or remotely to circulate the cooled air throughout the housing and over the components. Circulating air over a cooling source may reduce and/or eliminate an increased temperature of the housing during use. Effective cavity temperature management can be accomplished and even improved by eliminating large temperature flows from entering the cooking area of the room. A fan or other device for moving air may be used to move air inside housing, which may allow for humidity control within the housing, e.g., by power venting or condensation using a cooling source such as a thermoelectric device. A variable speed fan motor may be mounted inside or outside the cavity and may provide a variety of air flow patterns as desired to account for conditions within the housing, e.g., to remove moisture or adjust the internal temperature. Additionally, a sensor, e.g., for detecting current, voltage or resistance, may be used in conjunction with the fan motor to control the airflow in the system. The forced air cooling system may be synced with the operations of the induction controls so that the cooling blower may be automatically operated when operating the appliance to maintain the desired temperature within the housing of the cook top.

Sensors

Generally speaking, the system may feature any variety of AC or DC powered electronic, mechanical or electromechanical sensor used to detect a condition in the housing, e.g., temperature, resistance, magnetic field or current, in order to control the ventilator for heat management within the cook top appliance. Further, a sensor may be used for detecting and controlling the speed of the forced-air cooling fan for supplying cool air to the housing of the cook top.

According to one aspect of the present invention, a temperature sensor may be used with the induction cook top of the present invention to detect airflow temperatures, which may improve the overall functioning of the cook top and its components. For example, a temperature sensor may be located in the housing, and it may communicate with the electronic control system to detect the temperature and movement of air passing by the sensor. See FIGS. 9 and 11. A limit may be set with respect to the air temperature. Accordingly, when the temperature is above the limit, the electronic controls may facilitate the intake of air into the housing to cool the various components of the induction cook top. The limit may be adjustable based on the nature of the components in the cook top, e.g., for various types of induction hobs the BTU output may increases, thus requiring a greater degree of cooling. In another configuration, the electronic control board sets the temperature limits automatically, e.g., based upon a percentage relating to the efficiency of the system.

The sensors for temperature airflow may include simple, low cost models such, e.g., a thermocouple, as well as complex signals that communicate with the electronic control board. If the sensor detects a blockage, e.g., by detecting a reduction in the airflow, the sensor may communicate with the electronic control system, which may increase the airflow and adjust the temperature. Additionally, the user may be notified, e.g., by sound, by lights or by system shutdown. The user also may be notified if the system is malfunctioning, e.g., by system shutdown or various combinations of signals.

In accordance with another aspect of this invention, an induction cook top is designed to be controlled by electronics and equipped with an electronic temperature sensor located inside or on the cook top, within the housing, or in the top trim such that the temperature inside or on the cook top can be accurately detected. The system may include an AC or DC electronic heat/temperature sensor, which may provide improved control and operation response such as sensing the temperature in the cook top housing and then having the electronics control the exhausting and cooling functions and blower speed.

A variety of other sensors may be used in conjunction with the present invention, such as Resistance Temperature Detectors (RTD), Thermistors, IC sensors, Radiation Sensors Thermometers, bimetallic, IR and thermocouples. Preferably, the sensor is an RTD, which may be a less expensive sensor. An RTD may be relatively slower in response than other sensors, e.g., a thermocouple, but an RTD offers several advantages. For example, an RTD is inherently stable and generally resistive to thermal shock, thus avoiding errors that may occur in other sensors under similar conditions. This feature may be important when storing the product and transporting it to the end user. Another advantage of an RTD is that it does not require a special compensating lead wire or cold junction compensation. The operation of an RTD is generally based upon the electrical resistance of certain metals that increase and decrease in a predictable manner in response to a change in temperature. The most commonly used metals for an RTD are platinum, copper, and nickel. These metals are preferred because 1) they are available in near pure form, which is important to insure consistency in manufacturing process, 2) they offer a very predictable temperature/resistance relationship, i.e., it is substantially a linear relationship, and 3) they can be processed into extremely fine wire.

During operation, the sensor produces a signal and communicates the signal to a conditioning device, e.g., a transmitter. This transmitter is used to convert the signal from the sensor to an electrical signal that is recognizable by the electronic control board. Temperature transmitters may include various configurations such as a four-wire, three-wire or a two-wire circuit, but other methods can be used. Preferably, the connection between the RTD and the transmitter is a four-wire circuit. For example, this configuration may remove potential error that may be caused by mismatched resistance of lead wires. Specifically, a constant current is passed through each of the lead wires and a measurement for the voltage drop across the RTD is determined. With a constant current, the voltage is strictly a function of the resistance and an accurate measurement may be achieved. Thus, this method may provide a high degree of accuracy in detecting the temperature in the housing cavity of the induction cook top.

Preferably, the system also includes circuitry that provides data/information to the electronic control board. For example, as discussed above, the circuit may have an RTD to measure temperature in the housing. The information, e.g., the conditions in the housing, may be displayed to the user on an output display. After user input, the information may be processed by the electronic controls, which may then make adjustments accordingly, e.g., increasing or decreasing the fan speed, changing the settings of a thermoelectric device. Alternatively, the control may be automatic, e.g., the electronic control system may control the thermoelectric cooling system without user input. Such a circuit may be contained on a chip, which may be placed in any desired suitable for detection of the temperature within the housing.

Another sensor that may be used is a distributed temperature sensor ("DTS"). A DTS is a fiber optic distributed temperature sensor that senses temperature along a SS sheathed fiber, and it may feature a resolution of 0.5° C. and a spatial resolution of 1.5 m. A DTS fiber may range up to 2,000 m in length and may be coiled at specific points as desired. The fiber of a DTS may be sheathed with a nonconductive polymer for intrinsic applications, which may provide the ability to create a profile of the housing for detection of temperature within the housing. A DTS allows for detection of the temperature at many locations within the housing. The DTS, which may be contained on a strip, may be placed at any suitable location within the housing, e.g., along the bottom or top of the housing. Another advantage of a DTS is that the response time is shorter than with other sensors, which may enable the control board to control the temperature within a large portion of the housing. Additionally, the manufacturer may customize detection zones throughout the housing as desired without using additional sensors for detection.

Outdoor Use/Design

In accordance with another aspect of this invention, the induction cook top with a heat management system and systems heat control may be used in outdoor locations. As discussed above, the cook top may further be equipped with an integrated downdraft or telescoping ventilator using cross flow or centrifugal blower technology having the ability to weather the outdoor temperatures and environment. The use of a thermoelectric device for heat management may be better suited for outdoor use because, as detailed above, vents are not required, i.e., the housing will not be directly exposed to the elements. Moreover, a thermoelectric device may be better suited for outdoor use and potential exposure to extreme temperatures and weather conditions because a thermoelectric device does not have mechanical moving parts that may fail under such conditions. Additionally, a thermoelectric device may provide heat to the housing by reversing the current. Such a feature may be needed in cold climates when used outdoors to maintain an efficient temperature for the cook top to operate, particularly when first turned on. After the internal components reach a desired temperature, the thermoelectric device may then be used for cooling.

Installation

As discussed briefly above, the cook top of the present invention may be installed in a variety of structures, for example, above a cabinet or with a warmer drawer or wall oven. Therefore, many methods of installation are possible. However, for the sake of illustration, one method of installation above a cabinet is further described below.

Before installing the cook top, an installer should prepare an opening into which the cook top is to be inserted. For example, for a 36 inch model cook top, in one preferred counter top installation the opening is preferably about 34 inches by about 19 inches, with the opening positioned at least about 2 inches from the rear wall and at least about 2½ inches from the front edge of the counter. Additionally, the following clearances are preferred: at least about 30 inches from the top of the cook top to any overhead items, e.g., cabinets; at least about 2 inches between the side of the cook top and any walls; at least about 12 inches of clearance beneath the cook top. Additionally, surrounding items, e.g., cabinets may be insulated for protection from elevated temperatures. If the cook top is being installed above cabinet doors, there should be a clearance, preferably at least about 12 inches, between the bottom of the cook top and the drawer. A false drawer front may be used below the cook top if desired.

The following method may be used to install the cook top in a counter. First, place a towel or tablecloth on the counter top near the opening where the cook top is going to be installed. Then, place the cook top face down on the towel. Then, for embodiments wherein the barrier is transported separately from the cook top, attach the barrier 36 to the cook top, e.g., using screws. Next, apply a seal, e.g., foam tape, around the outer edge of the glass surface of the cook top. Then, insert the cook top into the opening in the counter and aligning the cook top in the opening as desired. Then, the cook top may be secured to the counter top, e.g., by using brackets and screws.

Various alternatives and modifications are contemplated as being within the scope of the following claims particularly pointing out and distinctly claiming the subject matter regarded as the invention. Many changes and modifications could be made to the invention without departing from the spirit thereof. The scope of these changes will become apparent from the appended claims.

What is claimed is:

1. An induction cook top appliance comprising:

a housing having a base, a set of sidewalls extending uprightly from the base, and an open top, the housing further having an air inlet and an air outlet;

a chassis mounted to the housing and defining an upper housing portion and a lower housing portion, wherein the lower housing portion includes a cavity, wherein the chassis has an intake vent in air communication with the air inlet and an exhaust vent in air communication with the air outlet;

a cooking surface attached to the housing and closing the upper housing portion;

an inductor coil mounted to the chassis below the cooking surface in the upper housing portion;

an induction generator operatively connected to the inductor coil;

a fan that draws air from the cavity of the lower housing portion through the intake vent and moves the air through the upper housing portion to exit the upper housing portion through the exhaust vent;

an electronic control system that controls the fan;

a barrier system in the lower housing portion that physically isolates the exhaust vent from the intake vent in the lower housing portion to prevent circulation of air from the exhaust vent through the cavity to the intake vent, wherein the barrier system includes a shield disposed in the lower housing and wherein the shield is angled toward the intake such that the shield is not positioned perpendicular to the base, wherein the barrier system includes multiple barriers and wherein the intake of a first fan and a second fan is individually ducted and separated by one of the multiple barriers; and a through-mounted, with respect to the housing, cooling device in thermal communication with the electronic control system.

2. The induction cook top according to claim 1, further comprising a sensor within the housing, wherein the sensor senses a condition within the housing and communicates the condition to the electronic control system.

3. The induction cook top according to claim 2, wherein the sensor is one of the following: a resistance temperature detector, a thermistor, an integrated circuit sensor, a radiation sensor thermometer, a thermocouple, or a distributed temperature sensor.

4. The induction cook top according to claim 1, wherein the cook top is used in conjunction with a telescoping downdraft ventilator.

5. The induction cook top according to claim 1, further comprising a user interface in the form of an electronic keypad adjacent the cooking surface, wherein the user interface is in communication with the electronic control system.

6. The induction cook top according to claim 1, further comprising a heat exchanger within the housing.

7. The induction cook top according to claim 1, wherein the barrier is adjustable to provide flexibility to install the induction cook top in one or more cabinets and adjusts to the varying depths found in the one or more cabinets.

8. The induction cook top according to claim 1, wherein the shield is hinged and wherein the shield is attached by at least one of screws, adhesive, and tape.

9. An induction cook top appliance comprising:

a cooking surface attached to a housing, the cooking surface extending along a first horizontal plane;

an inductor coil in the housing and below the cooking surface;

an induction generator operatively connected to the inductor coil;

an electronic cooling device mounted to the housing and extending along a second horizontal plane that is parallel to the first horizontal plane;

a fan adjacent the electronic cooling device;

an obliquely oriented shield that prevents air heated by the induction generator and exhausted from the housing from being re-circulated into the housing by the fan, thereby preventing an increase of the temperature inside the housing;

an electronic control system in communication with the electronic cooling device;

wherein the housing is sealed to substantially prevent air from escaping the housing; and wherein the obliquely oriented shield is one of a removable and a flip down barrier located on a bottom of the housing such that the barrier is movable to fold up against the bottom of the housing to provide a flat profile for shipping and then extended downwardly from the bottom when installed.

10. The induction cook top appliance according to claim 9, further comprising a sensor within the housing, wherein the sensor senses a condition within the housing and communicates the condition to the electronic control system.

11. The induction cook top appliance according to claim 9, wherein the electronic cooling device includes a thermoelectric device that is constructed of bismuth telluride.

12. An induction cook top appliance comprising:

a cooking surface attached to a housing, the cooking surface extending along a first horizontal plane;

an inductor coil in the housing and below the cooking surface;

an induction generator operatively connected to the inductor coil;

a through-mounted cooling device attached to the housing and extending along a second horizontal plane parallel to the first horizontal plane below the inductor coil;

a first fan positioned near a hot side of the cooling device, wherein the first fan has a blade arrangement that rotates about an axis of rotation that is normal to the first and the second horizontal planes;

a second fan positioned near a cold side of the cooling device and haying a blade arrangement configured to rotate about an axis of rotation normal to the first and the second horizontal planes;

an electronic control system in communication with the cooling device; and a barrier comprising a metal having a thickness with a folded edge and an angled flap for mounting to the bottom of the housing, and wherein the barrier extends away from the bottom of the housing and is configured to block the airflow from the exhaust such that the exhaust does not enter the intake permitting a cooling air to enter the intake.

13. The induction cook top appliance according to claim 12, wherein the first fan and the second fan are in communication with the electronic control system.

14. The induction cook top according to claim 12, wherein the housing is sealed with a foam sealing tape around an outer edge of the cook top to substantially prevent air from escaping the housing.

* * * * *